United States Patent [19]

Antonis et al.

[11] Patent Number: 4,795,943

[45] Date of Patent: Jan. 3, 1989

[54] HIGH-PRESSURE SODIUM VAPOR DISCHARGE LAMP

[75] Inventors: Petrus H. Antonis; Lodewijk H. M. Meessen; Ralf Schäfer, all of Eindhoven, Netherlands

[73] Assignee: U.S. Philips Corporation, New York, N.Y.

[21] Appl. No.: 43,504

[22] Filed: Apr. 28, 1987

[30] Foreign Application Priority Data

May 7, 1986 [NL] Netherlands ..... 8601162

[51] Int. Cl.[4] ..... H01J 61/073; H01J 61/38

[52] U.S. Cl. ..... 313/620; 313/623; 313/631

[58] Field of Search ..... 313/620, 623, 631

[56] References Cited

U.S. PATENT DOCUMENTS 2,714,687 8/1955 Isaacs et al. ..... 313/620

4,475,061 10/1984 van de Weiger et al. ..... 313/623

*Primary Examiner*—Leo H. Boudreau

*Assistant Examiner*—K. Wieder

*Attorney, Agent, or Firm*—Emmanuel J. Lobato

[57] ABSTRACT

A high-pressure sodium vapor discharge lamp having a ceramic discharge vessel, which has over a length L a substantially constant inner diameter and in which electrodes are arranged opposite to each other at a relative distance D. The lamp emits white light during operation and consumes a power of at most 50 watts. The lamp has a high efficiency and good color rendering due to the fact that $D/L \leqq 0.5$.

6 Claims, 1 Drawing Sheet

HIGH-PRESSURE SODIUM VAPOR DISCHARGE LAMP

BACKGROUND OF THE INVENTION

The invention relates to a high-pressure sodium vapor discharge lamp provided with a sealed ceramic discharge vessel which has over a length L a substantially constant inner diameter, in which discharge vessel electrodes are arranged opposite to each other at a relative distance D and are connected to a respective current-supply conductor, which extends through the wall of the discharge vessel to the exterior, which discharge vessel has a filling which comprises sodium and rare gas, which lamp consumes during operation a power of at most 50 W and emits light having a colour temperature of at least 2250 K. Such a lamp is known from British Patent Specification No. 20,83,281 and corresponding U.S. Pat. No. 4,475,061.

A lamp of this kind can be used to replace an incandescent lamp. The lamp emits "white light". In general, it holds for the color temperature ($T_c$) that $2250 \leqq T_c \leqq 2750$ K. The range in the color triangle (C.I.E. chromaticity diagram) within which the light of a high-pressure sodium discharge lamp is designated as "white" is bounded by straight lines through points with the coordinates (x, y): (0.468; 0.430), (0.510; 0.430), (0.485; 0.390) and (0.445; 0.390). According to more stringent standards based on a better acceptance of the light by testees, the light is designated as "white" when its color point lies in a range of the color triangle bounded by the lines $x=0.468$, $x=0.490$, $y=0.408$ and $y=0.425$. The color temperature then lies between about 2300 and about 2700 K and the general color rendering index ($Ra_8$) lies between about 70 and about 85.

Lamps of this kind are attractive as substitutes for incandescent lamps because of their a few times longer life, their a few times higher efficiency, their luminius flux corresponding to that of the larger incandescent lamps (about 60–200 W) and because of the fact that their light can be readily concentrated.

A disadvantage of lamps of this kind is that their efficiency is lower than that of high-pressure sodium lamps emitting yellow light ($T_c \approx 1800$–$2000$ K), i.e. lower as the color temperature is higher. Furthermore, the efficiency decreases with decreasing power.

SUMMARY OF THE INVENTION

The invention has for its object to provide a lamp of the kind described in the opening paragraph, which at a given color temperature and a given power has a higher efficiency than a similar known lamp having that color temperature and that power.

According to the invention, this object is achieved in a lamp of the kind described in the opening paragraph in that $D/L \leqq 0.5$.

The lamp according to the invention generally has a power in the range of 20–50 W. Lamps having a considerably lower power can be obtained only with difficulty by the known means. In order to prevent very high currents and hence high losses in the ballast of the lamp, the electrode distance D is generally at least 3 mm. On the other hand, it is conducive to the concentrability of the generated light when the discharge arc is not very long. The electrode distance D consequently lies generally between 3 and 13 mm. In general, the ratio D/L lies in the range of 0.15–0.5. With smaller ratios the gain in efficiency of the lamp decreases due to higher thermal losses at the ends of the discharge vessel and higher losses at the electrodes. With considerably larger ratios, there is no or substantially no gain in efficiency.

The term "ceramic" is to be understood to mean; a monocrystalline or polycrystalline material, such as sapphire, or translucent sintered aluminum oxide.

The lamp according to the invention can be operated in air or in a gas-filled or evacuated outer bulb.

BRIEF DESCRIPTION OF THE DRAWING

Embodiments of the lamp according to the invention are shown in the drawing. In the drawing.

DETAILED DESCRIPTION OF THE INVENTION

Figure 1:
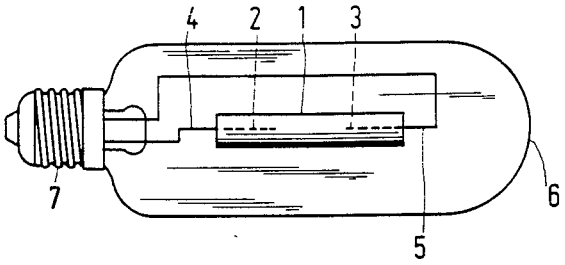
FIG. 1 is a side elevation of a lamp with an outer bulb.

In FIG. 1, the lamp has a sealed ceramic discharge vessel 1, which has over a length L an at least substantially constant inner diameter. In the discharge vessel 1 electrodes 2, 3 are arranged opposite to each other at a relative distance D, these electrodes being connected to a respective current-supply conductor 4, 5 extending to the exterior through the wall of the discharge vessel 1. The ratio $D/L \leqq 0.5$. The discharge vessel 1 is filled with sodium, mercury and rare gas. The discharge vessel 1 is arranged in an outer bulb 6, which has a lamp cap 7, to which the current-supply conductors 4, 5 are connected. The lamp consumes during operation a power of at most 50 W and emits light having a color temperature of at least 2250 K.

Figure 2:
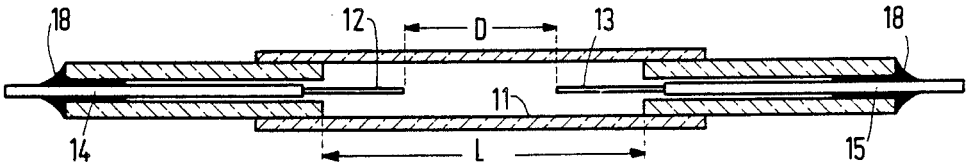
FIG. 2 is a longitudinal sectional view of a lamp.
Figure 3:
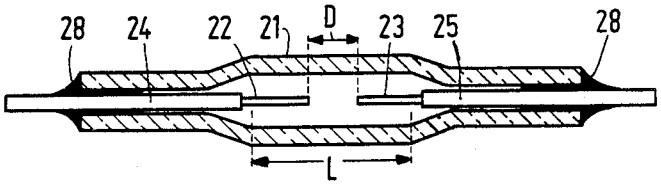
FIG. 3 is a longitudinal sectional view of another lamp.

In FIGS. 2 and 3, corresponding parts have a reference numeral which is 10 and 20, respectively, higher than in FIG. 1. Like in FIG. 1, in these Figures $D/L \leqq 0.5$. The discharge vessel 1, 11, 21 consists of polycrystalline aluminium oxide. The electrodes 12, 13 and 22, 23, respectively, consist of tungsten/rhenium (97/3, weight/weight), while the current-supply conductors 14, 15 and 24, 25 respectively, consist of niobium. The discharge vessels 11, 21 are sealed by means of melting ceramics 18 and 28 respectively.

From discharge vessels of the shape shown in FIG. 2 lamps were manufactured, which had different distances (D) between the tops of the pin-shaped electrodes, which had a diameter $\phi$ and which had different lengths (L) over which the discharge vessel had an at least substantially constant inner diameter of 2.5 mm. The discharge vessels were filled with Na/Hg=15/40 (weight/weight) and with xenon at a pressure of 50 kPa at 300 K. The lamps were operated in an evacuated outer bulb and their efficiency was measured. The color temperature of the generated light was 2450 K. The lamps were compared with a lamp having the same color temperature (No. 11) of Example 1 of the aforementioned British Patent Specification 20,83,281. There was further compared with a lamp (No. 12) which does not satisfy the requirement imposed according to the invention. These lamps (Nrs. 11 and 12) also had an evacuated outer bulb. The results are stated in Table 1.

TABLE 1

| lamp | $\phi(\mu m)$ | L(mm) | D(mm) | D/L | P(W) | $\eta$(lm/W) |
|---|---|---|---|---|---|---|
| 1 | 300 | 17 | 8 | 0.47 | 33 | 48 |
| 2 | 300 | 19 | 8 | 0.42 | 36 | 54 |
| 3 | 400 | 19 | 9 | 0.47 | 34 | 45 |
| 4 | 400 | 19 | 8 | 0.42 | 35 | 50 |
| 5 | 400 | 19 | 7 | 0.37 | 37 | 49 |
| 6 | 400 | 19 | 6 | 0.32 | 38 | 49 |
| 7 | 550 | 19 | 4 | 0.21 | 35 | 46 |
| 11 | 200 | 15 | 11 | 0.73 | 30 | 44 |
| 12 | 300 | 15 | 8 | 0.53 | 30 | 43 |

A considerable increase in efficiency for lamps according to the invention appears from these data in comparison with the known lamp (No. 11) and the lamp (No. 12) not satisfying the maximum value of D/L.

For explanation of the results in Table 1, the following should be noted. When the distance (D) between the electrodes is smaller, a larger current must flow through the lamp to dissipate therein the same quantity of energy. Due to the higher current, the temperature of the electrodes increases. Evaporation of electrode material can then lead to a more rapid blackening of the discharge vessel. In order to avoid this, electrodes of a larger diameter can be used. The use of thicker electrodes leads to higher losses in the electrodes and hence to a lower efficiency, however. This appears when comparing the lamps 2 and 4 of Table 1. From the viewpoint of efficiency, comparatively thin electrodes will therefore be chosen, while, in order to avoid blackening of the discharge vessel, a more than minimum electrode distance (D) will be chosen.

If, however, the envisaged use of the lamp makes it desirable to have a small distance between the electrodes, in order to avoid blackening thicker electrodes will be chosen and a decrease of the efficiency will be accepted. However, as appears from Table 1, the lamp according to the invention yields, even with a smaller distance between the electrodes (D) and with the use of thick electrodes, a high efficiency as compared with lamps not in accordance with the invention (compare lamp 7 with lamps 11 and 12).

European Patent Application No. 0 094 137A2 and corresponding U.S. Pat. No. 4,527,097 discloses a normal high-pressure sodium lamp (HF 68), i.e. a lamp emitting yellow light having the properties indicated in Table 2 (lamp 21). The same lamp was operated at a power of 50 W (lamp 22). For comparison, data are stated of a 50 W high-pressure sodium lamp (lamp 23), which is commercially available (Philips, SON 50 W, No. 9281 508 088). These lamps have a color temperature $T_c$ lying between 1800 and 2000 K.

TABLE 2

| lamp | L(mm) | D(mm) | D/L | P(W) | $\eta$(lm/W) |
|---|---|---|---|---|---|
| 21 | 24.4 | 12 | 0.49 | 30 | 35 |
| 22 | 24.4 | 12 | 0.49 | 50 | 52 |
| 23 | 39 | 28 | 0.72 | 50 | 70 |

It appears from Table 2 that with conventional high-pressure sodium lamps having a low color temperature the efficiency decreases considerably when the ratio D/L satisfies $D/L \leqq 0.5$. This is in sharp contrast with the increase in efficiency with lamps according to the invention emitting "white light" with $D/L \leqq 0.5$.

What is claimed is:

1. A high-pressure sodium vapor discharge lamp, comprising:

a sealed ceramic discharge vessel, which has over a length L an at least substantially constant inner diameter, discharge electrodes arranged in said discharge vessel opposite to each other at a relative distance D, said electrodes being connected to a respective current-supply conductor which extends to the exterior through the wall of the discharge vessel, a filling comprising sodium and rare gas in said discharge vessel, said lamp consuming during operation a power of at most 50 W and emitting light having a color temperature of at least 2250 K, and the ratio D/L having a value $D/L \leqq 0.5$.

2. A high-pressure sodium vapor discharge lamp according to claim 1, wherein said discharge electrodes are pin electrodes, and the ratio D/L has a value $0.15 \leqq D/L \leqq 0.5$.

3. A high-pressure sodium vapor discharge lamp according to claim 1, wherein the ration D/L has a value from about 0.32 to about 0.47.

4. A high-pressure sodium vapor discharge lamp according to claim 3, wherein said discharge electrodes are pin electrodes having a diameter of the order of several hundred micrometers.

5. A high-pressure sodium discharge lamp having an operating power dissipation not exceeding 50 watts and emitting during operation white light having a color temperature of at least 2250 K, said lamp comprising:

a sealed ceramic discharge vessel having a substantially constant inner diameter portion of length L;

a pair of pin electrodes disposed within said discharge vessel and spaced at opposite ends of the constant diameter portion of said discharge vessel to define a discharge gap of length D between them, and said pin electrodes having respective diameters of the order of several hundred micrometers;

the ratio D/L having a value from about 0.32 to about 0.47 selected to optimize the lamp in terms of efficiency and maintenance;

a pair of current-supply conductors each connected to a respective pin electrode and extending through said discharge vessel for permitting supply of electrical current to said pin electrodes; and a quantity of sodium and a rare gas within said discharge vessel.

6. An optimized high-pressure sodium discharge lamp having a high color rendering, comprising:

a sealed ceramic discharge vessel having a substantially constant inner diameter portion of length L;

a pair of pin electrodes having respective diameters of the order of several hundred micrometers disposed within said discharge vessel and spaced at opposite ends of the constant diameter portion of said discharge vessel to define a discharge gap of length D between them;

the ratio D/L having a value $0.15 \leqq D/L \leqq 0.5$;

a quantity of sodium and rare gas within said discharge vessel selected such that said lamp emits white light having a color point within the region of the C.I.E. chromaticity diagram bounded by the lines $X=0.468$, $x=0.490$, $y=0.408$ and $y=0.425$, a general color rendering index $R_8$ between about 70 to about 85, and a color temperature between about 2300 K to about 2700 K, and said lamp dissipating no more than 50 watts during operation; and a pair of current-supply conductors each connected to a respective pin electrode and extending through said discharge vessel for permitting supply of electrical current to said pin electrodes.

* * * * *